US008151901B2

(12) United States Patent
Keskiniva et al.

(10) Patent No.: US 8,151,901 B2
(45) Date of Patent: Apr. 10, 2012

(54) IMPACT DEVICE AND METHOD FOR GENERATING STRESS PULSE THEREIN

(75) Inventors: Markku Keskiniva, Tampere (FI); Jorma Mäki, Mutala (FI); Mauri Esko, Ikaalinen (FI); Erkki Ahola, Kangasala (FI); Aimo Helin, Tampere (FI); Timo Muuttonen, Siuro (FI)

(73) Assignee: Sandvik Mining and Construction Oy, Tampere (FI)

( * ) Notice: Subject to any disclaimer, the term of this patent is extended or adjusted under 35 U.S.C. 154(b) by 1287 days.

(21) Appl. No.: 10/563,821

(22) PCT Filed: Jul. 6, 2004

(86) PCT No.: PCT/FI2004/000429

§ 371 (c)(1),
(2), (4) Date: Jan. 6, 2006

(87) PCT Pub. No.: WO2005/002802

PCT Pub. Date: Jan. 13, 2005

(65) Prior Publication Data

US 2006/0157259 A1 Jul. 20, 2006

(30) Foreign Application Priority Data

Jul. 7, 2003 (FI) ..... 20031035

(51) Int. Cl.
*B25B 21/02* (2006.01)

(52) U.S. Cl. ..... 173/90; 173/206; 173/207; 173/208; 173/204; 173/138; 123/46 SC

(58) Field of Classification Search ..... 173/90, 173/206–208, 204, 138; 123/46 S, 46 SC
See application file for complete search history.

(56) References Cited

U.S. PATENT DOCUMENTS

| | | | | | |
|---|---|---|---|---|---|
| 787,960 | A | * | 4/1905 | Temple | 60/542 |
| 3,296,853 | A | * | 1/1967 | Beche | 72/453.01 |
| 4,102,408 | A | * | 7/1978 | Ludvigson | 173/2 |
| 4,676,323 | A | * | 6/1987 | Henriksson | 173/200 |
| 4,690,225 | A | * | 9/1987 | Tupitsyn et al. | 173/200 |
| 4,951,757 | A | * | 8/1990 | Hamada et al. | 173/115 |
| 5,392,865 | A | * | 2/1995 | Piras | 173/17 |

(Continued)

FOREIGN PATENT DOCUMENTS

FI 20011434 A 1/2003

(Continued)

*Primary Examiner* — Rinaldi I. Rada
*Assistant Examiner* — Michelle Lopez
(74) *Attorney, Agent, or Firm* — Morgan, Lewis & Bockius LLP

(57) ABSTRACT

A pressure fluid operated impact device comprising a frame (2) whereto a tool (3) is mountable movably in its longitudinal direction, and control means (7) for controlling pressure fluid feed to the impact device (1), as well as a method of generating a stress pulse in a pressure fluid operated impact device. The impact device (1) comprises a working chamber (8) and a transmission piston (9) moving therein. Energy charging means for charging energy of pressure fluid and the control means are coupled to allow periodically alternately pressure fluid to flow to the working chamber (8) and, correspondingly, to discharge pressure fluid from the working chamber (8). In the method, pressure fluid is fed to the working chamber (8), which produces a force pushing the transmission piston (9) in the direction of the tool (3), thus generating a stress pulse in the tool (3).

33 Claims, 5 Drawing Sheets

U.S. PATENT DOCUMENTS

| | | | | |
|---|---|---|---|---|
| 5,836,400 | A * | 11/1998 | Tupper et al. | 173/11 |
| 7,013,996 | B2 * | 3/2006 | Keskiniva et al. | 175/135 |
| 7,032,684 | B2 * | 4/2006 | Muuttonen et al. | 173/4 |
| 7,198,116 | B1 * | 4/2007 | Chen | 173/93 |
| 7,252,154 | B2 * | 8/2007 | Keskiniva et al. | 173/91 |
| 7,290,622 | B2 * | 11/2007 | Keskiniva et al. | 173/91 |
| 2004/0226752 | A1 * | 11/2004 | Keskiniva et al. | 175/135 |
| 2005/0139368 | A1 * | 6/2005 | Keskiniva et al. | 173/206 |
| 2006/0032649 | A1 * | 2/2006 | Keskiniva et al. | 173/213 |
| 2006/0185864 | A1 * | 8/2006 | Keskiniva et al. | 173/1 |
| 2007/0199725 | A1 * | 8/2007 | Keskiniva et al. | 173/90 |
| 2007/0246236 | A1 * | 10/2007 | Keskiniva et al. | 173/206 |

FOREIGN PATENT DOCUMENTS

| | | |
|---|---|---|
| GB | 2190147 | 11/1987 |
| WO | 03/004822 A1 | 1/2003 |

* cited by examiner

IMPACT DEVICE AND METHOD FOR GENERATING STRESS PULSE THEREIN

FIELD OF THE INVENTION

The invention relates to a pressure fluid operated impact device comprising a frame whereto a tool is mountable movably in its longitudinal direction, control means for controlling pressure fluid feed by the impact device, and means for generating a stress impulse in the tool by means of the pressure of a pressure fluid. The invention further relates to a method of generating a stress pulse in a pressure fluid operated impact device.

BACKGROUND OF THE INVENTION

In prior art impact devices, a stroke is generated by means of a reciprocating percussion piston, which is typically driven hydraulically or pneumatically and in some cases electrically or by means of a combustion engine. A stress pulse is generated in a tool, such as a drill rod, when the percussion piston strikes an impact surface of either a shank or a tool.

A problem with the prior art impact devices is that the reciprocating movement of the percussion piston produces dynamic accelerating forces that complicate control of the apparatus. As the percussion piston accelerates in the direction of impact, the frame of an impact device tends to simultaneously move in the opposite direction, thus reducing the compressive force of the end of the drill bit or the tool with respect to the material to be processed. In order to maintain a sufficiently high compressive force of the drill bit or the tool against the material to be processed, the impact device must be pushed sufficiently strongly towards the material. This, in turn, requires the additional force to be taken into account in the supporting and other structures of the impact device, wherefore the apparatus will become larger and heavier and more expensive to manufacture. Due to its mass, the percussion piston is slow, which restricts the reciprocating frequency of the percussion piston and thus the striking frequency, although it should be significantly increased in order to improve the efficiency of the impact device. However, in the present solutions this results in far lower efficiency, wherefore in practice it is not possible to increase the frequency of the impact device.

BRIEF DESCRIPTION OF THE INVENTION

An object of the present invention is to provide an impact device so as to enable drawbacks of dynamic forces produced by the operation of such an impact device to be smaller than those of the known solutions, and a method of generating a stress pulse. The impact device according to the invention is characterized in that the impact device comprises a working chamber entirely filled with pressure fluid and, in the working chamber, a transmission piston movably mounted in the longitudinal direction of the tool with respect to the frame, an end of the transmission piston facing the tool coming into contact with the tool either directly or indirectly at least during the generation of the stress pulse, the transmission piston, with respect to the tool in its axial direction on the opposite side thereof, being provided with a pressure surface located towards the working chamber, the impact device comprises energy charging means for charging energy of the pressure fluid to be fed to the impact device and necessary for generating the stress pulse, and in that the control means are coupled to allow periodically alternately a pressure fluid having a pressure higher than the pressure of the pressure fluid present in the working chamber to flow to the working chamber, thus causing a sudden increase in the pressure in the working chamber and, consequently, a force pushing the transmission piston in the direction of the tool, compressing the tool in the longitudinal direction and thus generating a stress pulse in the tool, the generation of the stress pulse ending substantially at the same time as the influence of the force on the tool ends, and, correspondingly, to discharge pressure fluid from the working chamber.

The method according to the invention is characterized in that a pressure fluid having a pressure higher than the pressure of the pressure fluid present in the working chamber is fed to a working chamber of the impact device, the working chamber being entirely filled with pressure fluid, which, as a result of a sudden increase in the pressure in the working chamber, produces a force pushing the transmission piston in the direction of the tool, compressing the tool in the longitudinal direction and thus generating a stress pulse in the tool, the generation of the stress pulse ending substantially at the same time as the influence of the force on the tool ends, and, correspondingly, to discharge pressure fluid from the working chamber.

The idea underlying the invention is that an impact is produced by utilizing energy being charged in a fluid while the fluid is being compressed, the energy being transferred to a tool by allowing the pressurized fluid to suddenly influence a transmission piston provided in a working chamber such that the transmission piston compresses the tool in its axial direction due to the influence of a pressure pulse, thus producing an impact, i.e. a stress pulse, in to the tool. The idea underlying yet another preferred embodiment of the invention is that the impact device, for charging energy, is provided with an energy charging space whereto pressure fluid is fed from a pressure fluid pump, and that in order to generate a stress pulse, pressure fluid is discharged periodically from the energy charging space to influence the transmission piston in order to generate a stress pulse. Furthermore, the idea underlying a second preferred embodiment is that the volume of the energy charging space is large as compared with the volume of the pressure fluid amount to be fed to the working chamber during the generation of one stress pulse, preferably at least approximately 5 to 10 times as large. Furthermore, the idea underlying a third preferred embodiment of the invention is that pressure fluid is fed continuously to the energy charging space when the impact device is in operation.

An advantage of the invention is that the impulse-like impact movement thus generated does not necessitate a reciprocating percussion piston, wherefore no large masses are moved back and forth in the direction of impact, and the dynamic forces are small as compared with the dynamic forces of the reciprocating, heavy percussion pistons of the known solutions. A further advantage of this structure is that it is quite simple, and thus easy, to implement.

BRIEF DESCRIPTION OF THE DRAWINGS

The invention is described in closer detail in the accompanying drawings, in which FIG. 1 schematically shows an operating principle of an impact device according to the invention, FIG. 2 schematically shows an embodiment of the impact device according to the invention, FIG. 3 schematically shows a second embodiment of the impact device according to the invention, FIGS. 4*a* and 4*b* schematically show stress pulses obtained by embodiments of the impact device according to the invention, FIGS. 5*a* and 5*b* schematically show pulse energies and energy losses of the embodiments of the impact device shown in FIGS. 4*a* and 4*b*, FIGS. 6*a* and 6*b* schematically show a third embodiment of the impact device according to the invention, and FIG. 7 schematically shows a fourth embodiment of the impact device according to the invention.

DETAILED DESCRIPTION OF THE INVENTION

Figure 1:
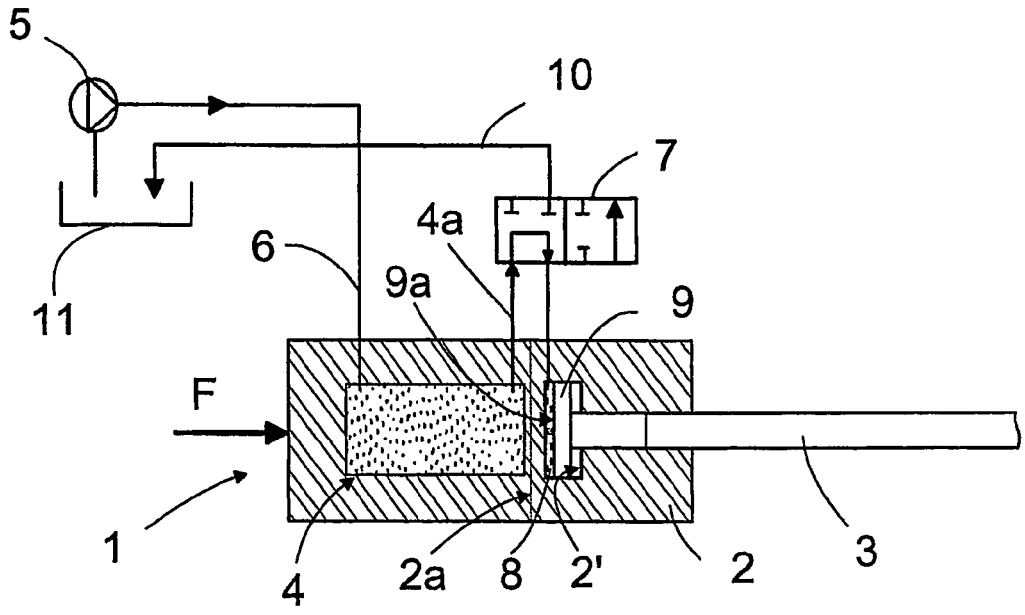

FIG. 1 schematically shows an operating principle of an impact device according to the invention. It shows an impact device 1 and its frame 2, and at one end of the frame a tool 3 movably mounted in its longitudinal direction with respect to the impact device 1. The impact device further comprises an energy charging space 4, which may be located inside the frame 2 or it may be a separate pressure fluid tank attached thereto. This alternative is illustrated in broken line 2*a*, designating a possible joint between a separate frame and a pressure fluid tank. The energy charging space 4 may also comprise one or more hydraulic accumulators. The energy charging space 4 is entirely filled with pressure fluid. When the impact device is in operation, pressure fluid is fed to the energy charging space 4 e.g. continuously by means of a pressure fluid pump 5 via a pressure fluid inlet channel 6. By means of a feed channel 4*a*, the energy charging space 4 is further coupled to a control valve 7, which controls pressure fluid feed to a working chamber 8. In the working chamber 8, a transmission piston 9 resides between the working chamber and the tool 3, the transmission piston being able to move in the axial direction of the tool 3 with respect to the frame 2. The working chamber 8 is also entirely filled with pressure fluid. The pressure influencing the pressure fluid in the energy charging space 4 compresses the pressure fluid with respect to the pressure acting thereon.

When being used, the impact device is pushed forward such that an end of the tool 3 is, directly or via a separate connecting piece, such as a shank or the like, firmly pressed against the transmission piston 9 at least during the generation of a stress pulse. Consequently, the transmission piston may first have almost no contact with the tool, as long as it substantially immediately at the outset of the generation of the stress pulse starts influencing the tool. When, by means of the control valve 7, pressure fluid is allowed to flow suddenly from the energy charging space 4 to the working chamber 8, it influences a pressure surface 9*a* of the transmission piston facing away from the tool in its axial direction. A sudden stream of pressurized pressure fluid to the working chamber 8 generates a pressure pulse and, as a result, a force affecting the transmission piston 9, pushing the transmission piston 9 towards the tool 3 and thus compressing the tool in its longitudinal direction. As a result, a stress pulse is generated in a drill rod or some other tool, and in propagating to the tool end as a wave, the stress pulse produces an impact therein in the material to be processed, as in the prior art impact devices. After the stress pulse has been generated, the connection from the energy charging space 4 to the working chamber 8 is cut off by means of the control valve 7 so that the generation of the stress pulse ends, and the pressure from the working chamber 8 is discharged by connecting the working chamber 8 to a pressure fluid tank 11 via a return channel 10.

The influence of the force generated in the tool 3 by the transmission piston 9 may also be ended in ways other than by stopping the pressure fluid feed to the working chamber 8. This may be implemented e.g. such that the movement of the transmission piston 9 is stopped against a shoulder 2', in which case the pressure acting behind the transmission piston 9 is no longer capable of pushing it towards the tool 3 with respect to the frame 2. Also in this embodiment, pressure fluid is allowed to flow from the working chamber 8 via the return channel 10 to the pressure fluid tank 11 so that the transmission piston 9 may return to its original position.

The generation of the stress pulse in the tool 3 provided as a result of the force generated by the pressure pulse acting in the working chamber 8 ends substantially at the same time as the influence of the force on the tool ends, although an insignificant delay does, however, occur therebetween.

In order to make a sufficient amount of energy to transfer to the working chamber 8 and therethrough to the transmission piston 9, the volume of the energy charging space 4 has to be substantially larger than the volume of the amount of pressure fluid fed to the working chamber 8 during the generation of one stress pulse. Furthermore, the distance between the energy charging space 4 and the working chamber 8 has to be relatively short and, correspondingly, the cross-sectional area of the feed channel 4*a* should be relatively large in order to keep flow losses as small as possible.

Figure 2:
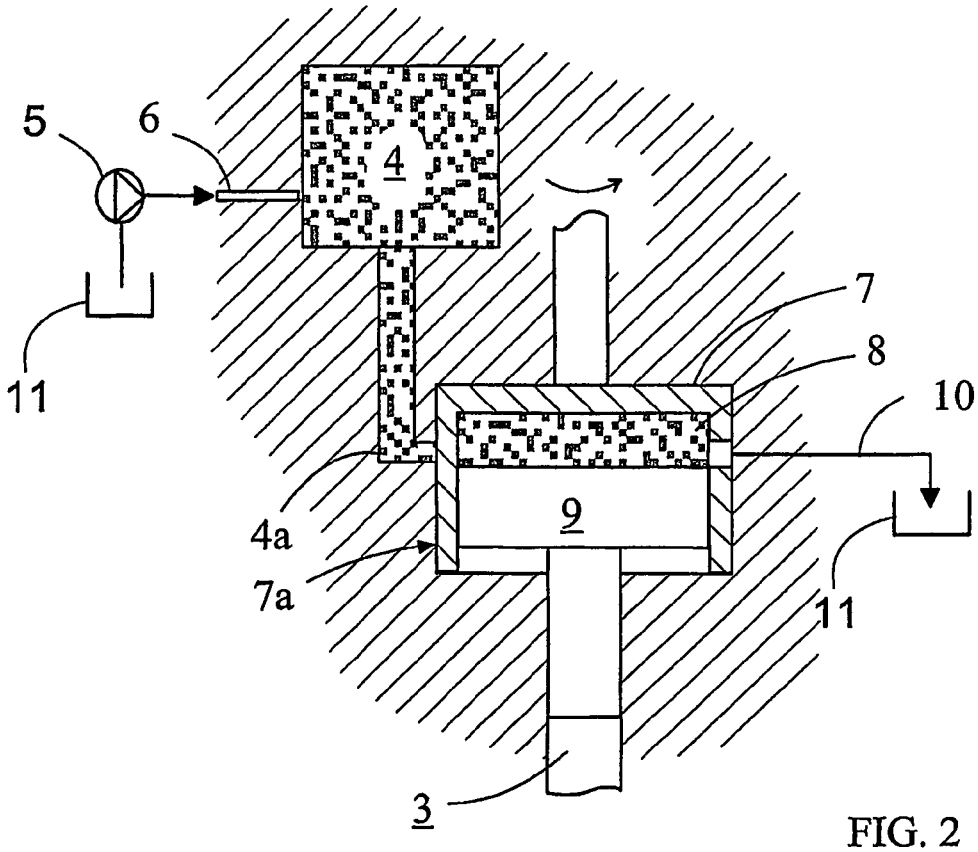

FIG. 2 schematically shows an embodiment of the impact device according to the invention. In this embodiment, pressure fluid is fed via the inlet channel 6 to the energy charging space 4. In this embodiment, the control valve 7 is a rotating valve comprising a sleeve-like control element 7*a* around the working chamber 8 and the transmission piston 9. The control element 7*a* is provided with one or more openings to periodically alternately allow pressure fluid to flow from the energy charging space 4 through the feed channel 4*a* to the working chamber and, similarly, therefrom.

The length of the feed channel 4*a* between the energy charging space 4 and the control valve 7 is $L_k$. Before the opening of the control element 7*a* opens the connection from the feed channel 4*a* to the working chamber 8, the pressure in the energy charging space 4 and in the feed channel 4*a* is the same, that is $p_t$. Correspondingly, the pressure in the working chamber is a "tank pressure", i.e. the pressure in the working chamber is approximately zero. When, while rotating, the control valve 7 reaches a situation wherein the opening of the control element 7*a* opens the connection from the feed channel 4*a* to the working chamber 8, pressure fluid is allowed to flow to the working chamber. The pressure in the feed channel 4*a* outside the control valve decreases and, correspondingly, the pressure in the working chamber increases so that the pressures become equal in magnitude. At the same time, a negative pressure wave is generated, which propagates in the feed channel 4*a* towards the energy charging space 4. It takes the negative pressure wave time $t_k$ to reach the energy charging space 4. The elapsed time can be determined by the formula $$t_k = \frac{L_k}{c_{oil}},$$

wherein $c_{oil}$ is the velocity of sound in the pressure fluid used. When the pressure wave reaches the energy charging space 4, the pressure of the feed channel 4*a* tends to drop, and at the same time pressure fluid flows from the substantially constant pressure energy charging space to the feed channel 4*a*. This, in turn, results in a positive pressure wave, which now propagates via the feed channel 4*a* towards the working chamber 8. If the connection from the feed channel 4*a* through the opening of the control element 7*a* of the control valve to the working chamber is still open, the positive pressure wave discharges into the working chamber. Again, if the pressure in the working chamber 8 is still lower than the pressure in the energy charging space 4, a new negative pressure wave is generated which again propagates towards the energy charging space 4 and which again is reflected back as a positive pressure wave. This phenomenon is repeated until the pressure between the working chamber 8 and the energy charging space 4 has evened out, or the control valve 7 closes the connections therebetween. When the length $L_k$ of the feed channel is selected such that the pressure wave has enough time to travel the distance $L_k$ back and forth at least once when the connection between the feed channel 4*a* and the working chamber 8 is open, this results in a progressive pressure increase in the working chamber 8. This, again, results in the shape of the stress pulse caused in the tool 3 also being progressive in shape.

Figure 3:
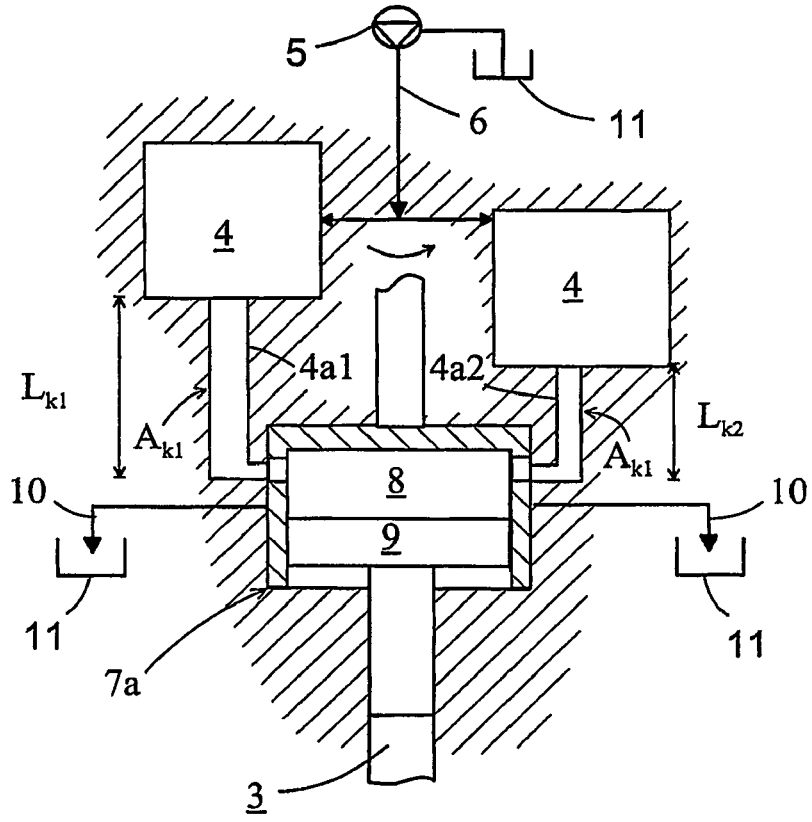

FIG. 3 schematically shows a second embodiment of the impact device according to the invention. It shows an embodiment wherein pressure fluid is fed from the energy charging space 4 to the working chamber 8 via two separate feed channels 4*a*1 and 4*a*2. For the sake of simplicity, the energy charging spaces are shown as two separate units.

In this embodiment, a feed channel 4*a*1 whose length is $L_{k1}$ and whose cross-sectional area is $A_{k1}$ leads from the energy charging space to the control valve 7. The dimensions of the aforementioned length and cross-sectional area are larger than those of length $L_{k2}$ and cross-sectional area $A_{k2}$ of a second feed channel 4*a*2. In this embodiment, the stress pulse is generated mainly in the same manner as described in connection with FIG. 2. In this case, however, the travel times of the pressure waves in the feed channels 4*a*1 and 4*a*2 are different since the channels have different dimensions. Correspondingly, the influences of the pressure waves travelling in the feed channels 4*a*1 and 4*a*2 on the increase in the pressure of the working chamber 8 are different since the cross-sectional areas of the feed channels 4*a*1 and 4*a*2 also differ in size. Consequently, the discharge of the pressure wave travelling in the smaller feed channel 4*a*2 into the working chamber 8 increases the pressure less since the change in volume relating to the pressure wave is also smaller. By selecting the lengths and cross-sectional areas of the feed channels 4*ai* (i=1–n) appropriately, the increase in the pressure of the working chamber 8 can be adjusted more effectively than would be possible by using one feed channel only. The number of feed channels may be one, two or more, as necessary, although as few as three feed channels of appropriate length suffice to enable the shape and strength of a stress pulse to be quite effectively adjusted in a desired manner.

Figure 4A:
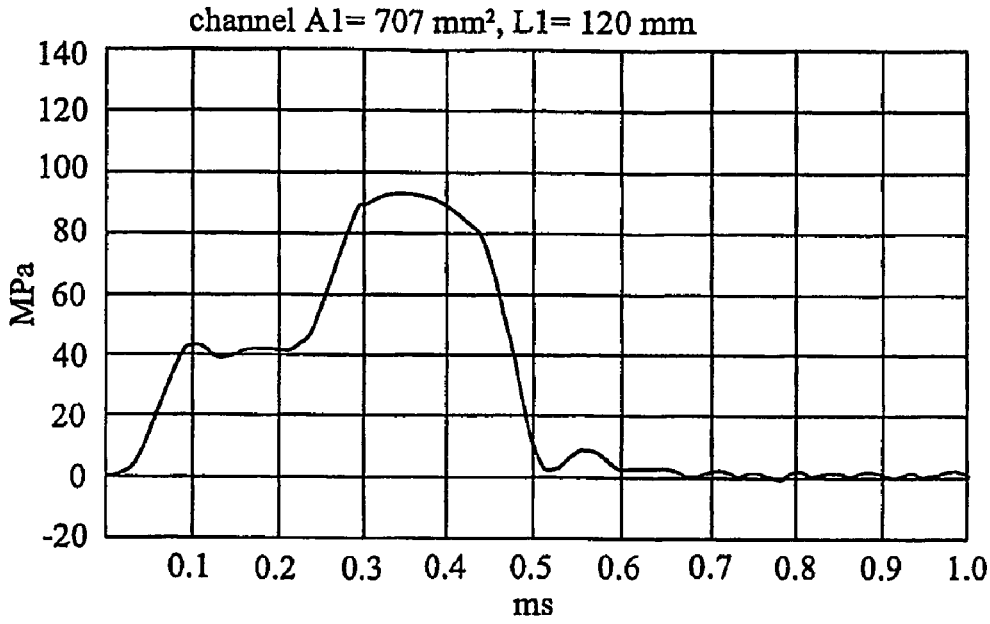
Figure 4B:
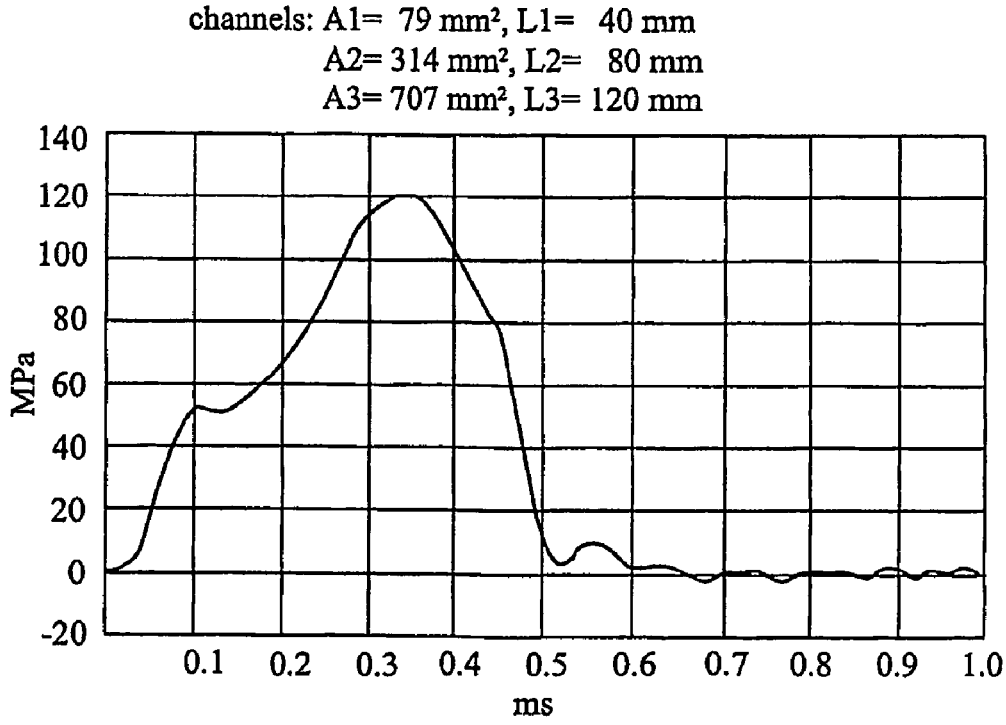

FIGS. 4*a* and 4*b* schematically show the shape and strength of stress pulses generated by means of the embodiments shown in FIGS. 2 and 3, respectively. FIG. 4*a* shows a stress pulse according to the solution shown in FIG. 2, showing how opening the control valve first causes a stress increase from zero to approximately 40 Mpa and, subsequently, the reflection of stress pulses results in a second increase, the resulting peak value of stress then being approximately 90 Mpa. The solution of FIG. 4*b* employs three feed channels that have different dimensions. FIG. 4*b*, in turn, shows stress pulses generated by means of the embodiment according to FIG. 3. First, a stress increase occurs therein which subsequently, due to the influence of the pressure pulses of both feed channels 4*a*1 and 4*a*2, increases as a whole to approximately 120 MPa. Thus, the same pressure in the energy charging space enables a stress pulse of a more desired shape to be generated while at the same time the maximum value of the stress pulse increases approximately 30% as compared with the solution shown in FIG. 2. Similarly, this applies to a plurality of cases. The use of a plurality of different feed channels also improves the efficiency of the impact device. Since the valve to some extent always operates as a choke, energy will always be lost, which can be calculated from the formula $$E_h = \int q \Delta p dt,$$

wherein q is the flow over the choke, and Δp is the pressure difference over the choke. By using appropriately long pressure fluid feed channels, the pressure difference over the control valve evens out very quickly without the pressures in the energy charging space 4 and in the working chamber 8 having to be the same. As a result, the energy loss caused by the control valve is smaller.

Figure 5A:
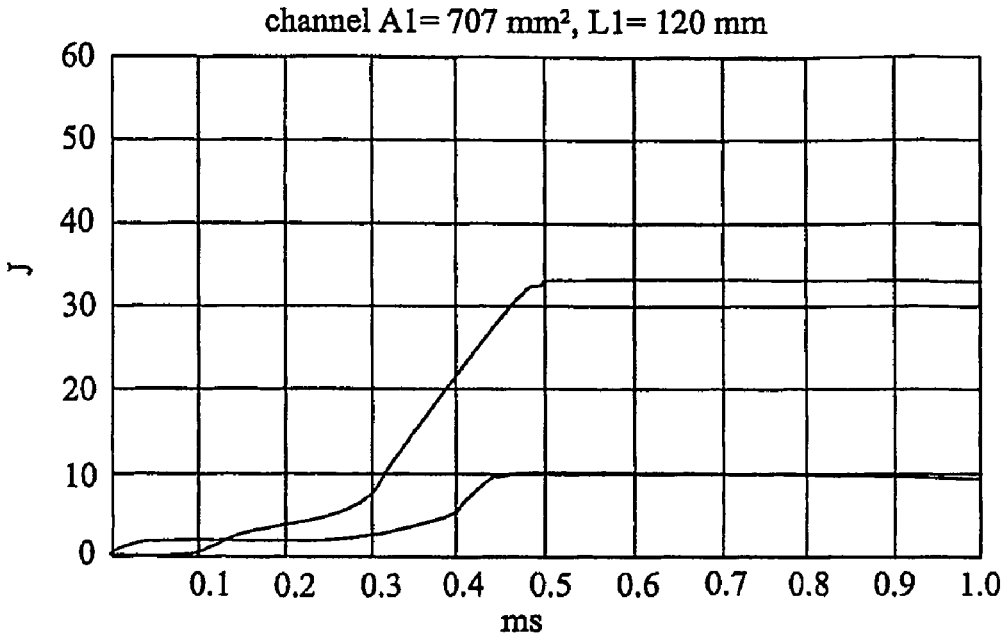
Figure 5B:
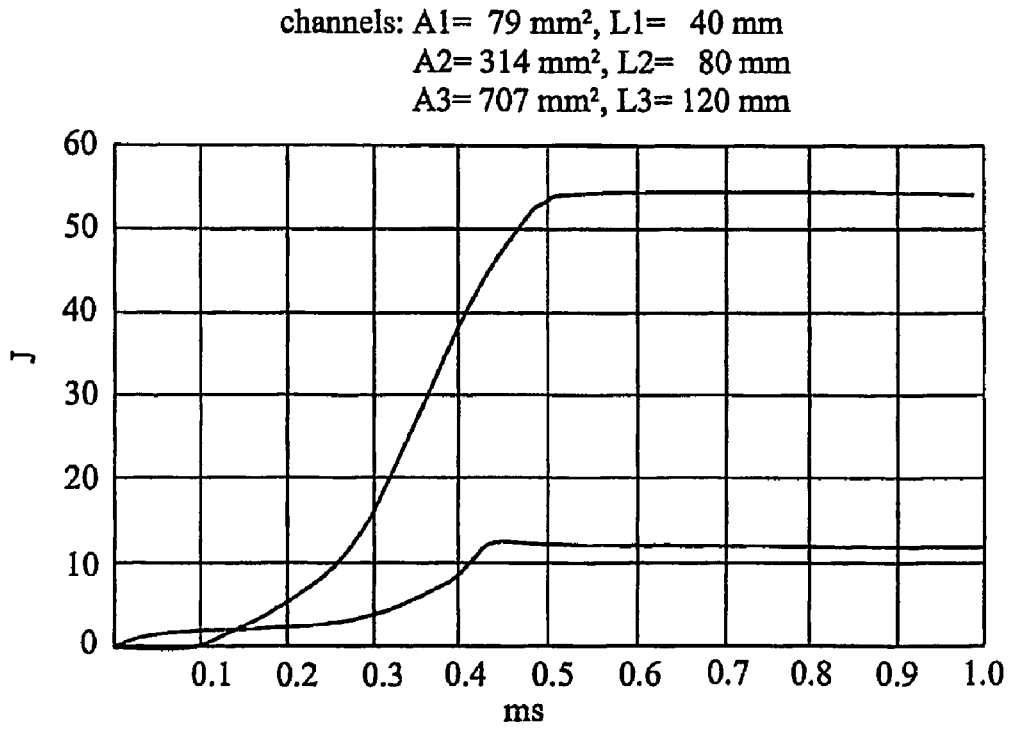

FIGS. 5*a* and 5*b* show pulse energies produced from the respective embodiments in FIGS. 4*a* and 4*b* as well as energy losses in the choke over the control valve. As can be seen in the figures, in the embodiment equipped with one feed channel, the pulse energy is approximately 35 J at its maximum while the energy loss is approximately 10 J. In the solution implemented using three feed channels, the pulse energy is approximately 55 J while the energy loss is approximately 13 J, in which case the net benefit in the case according to FIG. 5*a* is approximately 25 J, and in the case according to FIG. 5*b* approximately 42 J.

Figure 6B:
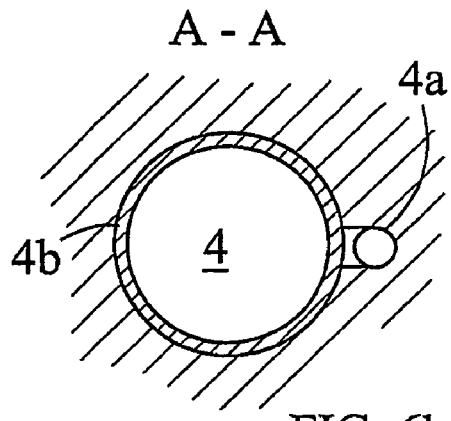
Figure 6A:
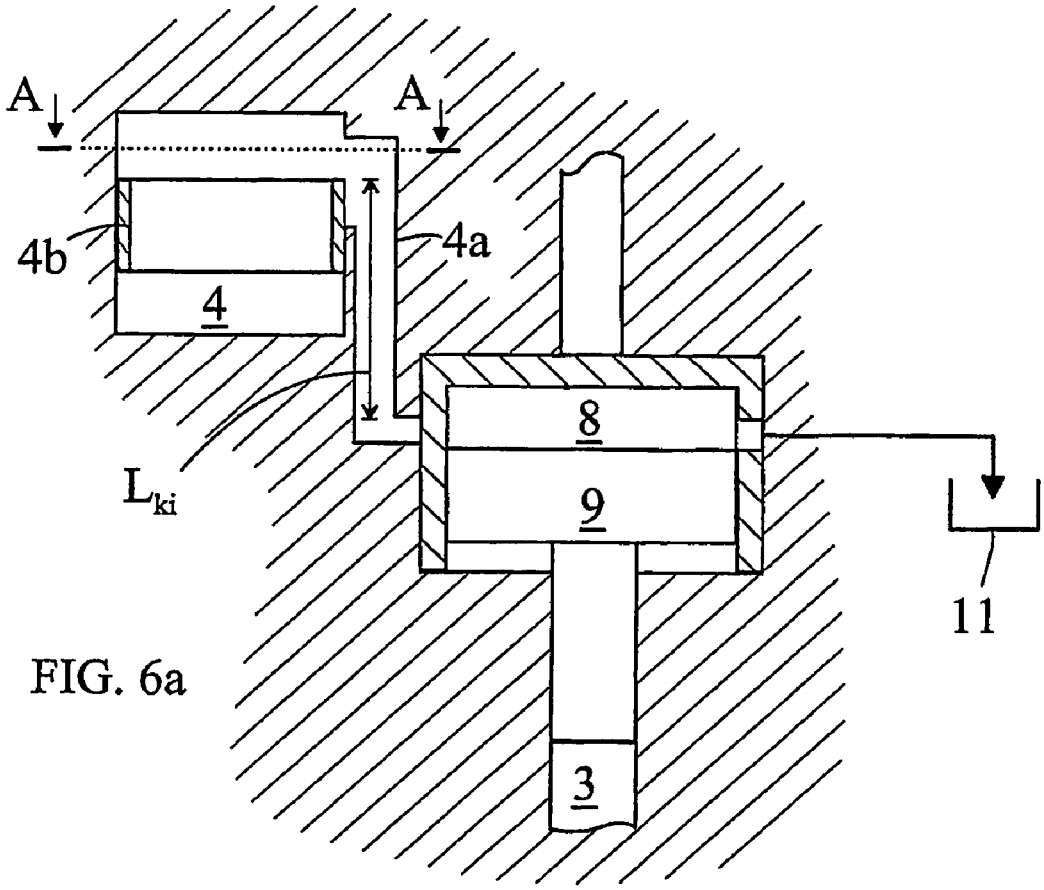

FIGS. 6*a* and 6*b* show a way to implement length adjustment of feed channels when the shape and properties of a stress pulse are to be adjusted. This embodiment employs a solution wherein the connection length $L_{ki}$ of a feed channel 4*a* is adjustable by using an adjustment sleeve 4*b* residing inside the energy charging space 4. By moving the position of the adjustment sleeve 4*b*, the connection of the feed channel 4*a* to the working chamber 8 can be moved closer to or farther away from the energy charging space 4 so that the flow of pressure fluid and the influence thereof on the stress pulse changes correspondingly. FIG. 6*b* shows the solution according to FIG. 6*a* cut along line A-A.

Figure 7:
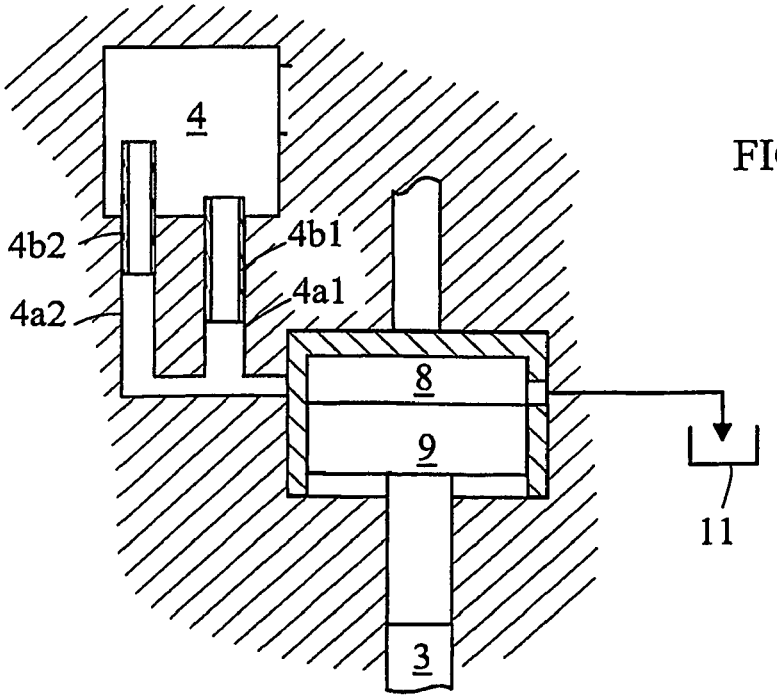

FIG. 7 schematically shows another embodiment for adjusting the length of feed channels of the impact device according to the invention. This embodiment employs adjustment sleeves 4*b*1 and 4*b*2 residing in one or more feed channels, in the case shown in FIG. 7 in two feed channels 4*a*1 and 4*a*2, that can be moved in the longitudinal direction of the corresponding feed channel towards the working chamber 8 and, similarly, away from it. This, again, enables the length of the feed channels leading from the energy charging space 4 to the working chamber 8, and thus the shape and other properties of the stress pulse, to be adjusted.

In the above description and drawings, the invention has been disclosed by way of example only, and it is by no means restricted thereto. The disclosed embodiments only show the invention schematically; similarly, the valves and couplings relating to pressure fluid feed have only been set forth schematically. The invention may be implemented using any suitable valve solutions. The point is that in order to generate a stress pulse in a tool, and in order to provide a desired impacting frequency, a pressure fluid is used which, at desired intervals, is conveyed as pressure pulses to influence the pressure surface of a transmission piston such that a stress pulse is generated in the tool, the stress pulse propagating through the tool to the material to be processed. The transmission piston may be a unit separate from the tool, but in some cases it may also be an integral part of the tool.

The invention claimed is:

1. A pressure fluid operated impact device comprising a frame whereto a tool is mountable movably in its longitudinal direction, control means for controlling pressure fluid feed of the impact device, and means for generating a stress pulse in the tool by the pressure of a pressure fluid, wherein the impact device comprises a working chamber entirely filled with pressure fluid and, in the working chamber, a transmission piston movably mounted in the longitudinal direction of the tool with respect to the frame, an end of the transmission piston facing the tool coming into contact with the tool either directly or indirectly at least during the generation of the stress pulse, the transmission piston, in its axial direction with respect to the tool on the opposite side thereof, being provided with a pressure surface located towards the working chamber, the impact device comprises energy charging means for charging energy of the pressure fluid to be fed to the impact device necessary for generating the stress pulse, and in that the control means are configured to allow periodically and alternately a pressure fluid having a pressure higher than the pressure of the pressure fluid present in the working chamber to flow to the working chamber, thus causing a sudden increase in the pressure in the working chamber and, consequently, a force pushing the transmission piston in the direction of the tool, compressing the tool in the longitudinal direction and thus generating a stress pulse in the tool, the generation of the stress pulse ending substantially at the same time as the influence of the force on the tool ends, and, correspondingly, to discharge pressure fluid from the working chamber in order to enable the transmission piston to return to its substantially original position.

2. An impact device as claimed in claim 1, wherein in order to stop the influence of the force, the control means are configured to prevent pressure fluid from entering the working chamber.

3. An impact device as claimed in claim 1, wherein the control means are configured to stop the influence of the force by discharging pressure fluid from the working chamber.

4. An impact device as claimed in claim 1, further comprising stop elements for stopping the movement of the transmission piston in the direction of the tool such that the influence of the force on the tool ends.

5. An impact device as claimed in claim 1, wherein the impact device, as an energy charging means, comprises an energy charging space which is entirely filled with pressurized pressure fluid and whose volume is substantially large as compared with the volume of a pressure fluid amount to be fed to the working chamber during the generation of one stress pulse.

6. An impact device as claimed in claim 5, wherein when the impact device is in operation, pressure fluid is fed to the energy charging space such that a predetermined pressure level is maintained in the energy charging space, and that the control means are configured to allow periodically and alternately pressure fluid to flow from the energy charging space to the working chamber and, consequently, to close the connection between the energy charging space and the working chamber.

7. An impact device as claimed in claim 5, wherein the energy charging space is a tank whose walls, due to the influence of pressure, yield such that the volume of the energy charging space increases as pressure increases.

8. An impact device as claimed in claim 5, wherein the energy charging space is a tank separate from the frame.

9. An impact device as claimed in claim 5, wherein at least one energy charging space is a hydraulic accumulator.

10. An impact device as claimed in claim 1, wherein the control means comprise a rotating control valve comprising a plurality of successive openings in the direction of rotation thereof in order to feed pressure fluid from an energy charging space via a plurality of feed channels to the working chamber simultaneously.

11. An impact device as claimed in claim 10, wherein the length and cross-section of each feed channel are mutually the same.

12. An impact device as claimed in claim 1, further comprising at least two feed channels which differ in length or cross-sectional area or both and which lead from an energy charging space to the working chamber.

13. An impact device as claimed in claim 12, further comprising at least one valve to activate and deactivate the feed channels differing in length and/or cross-sectional area.

14. An impact device as claimed in claim 1, wherein a length of at least one feed channel from an energy charging space to the working chamber is adjustable.

15. An impact device as claimed in claim 1, wherein the transmission piston is a membrane type piston.

16. An impact device as claimed in claim 1, wherein the feed force of the impact device is used for pushing the transmission piston back to its pre-stress-pulse position.

17. An impact device as claimed in claim 1, further comprising means for returning the transmission piston after an impact to its pre-impact position with respect to the impact device by bringing a separate force acting between the impact device and the transmission piston to influence the transmission piston, the force pushing the transmission piston towards the working chamber.

18. An impact device as claimed in claim 1, wherein the length of movement of the transmission piston in the working chamber is at least one millimeter.

19. A method of generating a stress pulse in a pressure fluid operated impact device as claimed in claim 1, wherein a pressure fluid having a pressure higher than the pressure of the pressure fluid present in the working chamber is fed to a working chamber of the impact device, the working chamber being entirely filled with pressure fluid, which, as a result of a sudden increase in the pressure in the working chamber produces a force pushing the transmission piston in the direction of the tool, compressing the tool in the longitudinal direction and thus generating a stress pulse in the tool, the generation of the stress pulse ending substantially at the same time as the influence of the force on the tool ends, and, correspondingly, to discharge pressure fluid from the working chamber in order to enable the transmission piston to return to its substantially original position.

20. A method as claimed in claim 19, wherein as an energy charging means, an energy charging space which is entirely filled with pressurized pressure fluid and whose volume is substantially large as compared with the volume of a pressure fluid amount to be fed to the working chamber during the generation of one stress pulse.

21. A method as claimed in claim 20, wherein when the impact device is in operation, pressure fluid is fed to the energy charging space such that a predetermined pressure level is maintained in the energy charging space, and that the control means are coupled to allow periodically and alternately pressure fluid to flow from the energy charging space to the working chamber and, consequently, to close the connection between the energy charging space and the working chamber.

22. A method as claimed in claim 19, wherein a rotating control valve is used as a control means, comprising a plurality of successive openings in the direction of rotation thereof in order to feed pressure fluid from an energy charging space via a plurality of feed channels to the working chamber simultaneously.

23. A method as claimed in claim 19, wherein pressure fluid is fed from an energy charging space to the working chamber via at least two feed channels which are mutually the same in length and/or cross-sectional area.

24. A method as claimed in claim 19, wherein pressure fluid is fed from an energy charging space to the working chamber via at least two feed channels which differ in length and/or cross-sectional area.

25. A method as claimed in claim 24, wherein for adjustment of properties of a stress signal, feed channels which differ in length and/or cross-sectional area are activated and deactivated.

26. A method as claimed in claim 19, wherein a length of at least one feed channel from an energy charging space to the working chamber is adjustable.

27. A method as claimed in claim 19, wherein as the energy charging space, a tank is used whose walls, due to the influence of pressure, yield such that the volume of the energy charging space increases as pressure increases.

28. A method as claimed in claim 19, wherein as the energy charging space, a tank separate from the frame is used.

29. A method as claimed in claim 19, wherein as at least one energy charging space, a hydraulic accumulator is used.

30. A method as claimed in claim 19, wherein as the transmission piston, a membrane type piston is used.

31. A method as claimed in claim 19, wherein the transmission piston is pushed back to its pre-stress-pulse position by using the feed force of the impact device.

32. A method as claimed in claim 19, wherein for returning the transmission piston after an impact to its pre-impact position with respect to the impact device, a separate force acting between the impact device and the transmission piston is arranged to influence the transmission piston, the force pushing the transmission piston towards the working chamber.

33. A method as claimed in claim 19, wherein when generating a stress pulse, the transmission piston is moved for at least one millimeter in the working chamber.

* * * * *